US009751670B2

(12) United States Patent
Williams et al.

(10) Patent No.: US 9,751,670 B2
(45) Date of Patent: Sep. 5, 2017

(54) TWIST OFF CABLE TIE FASTENER

(71) Applicants: Mark Kent Williams, Colbert, WA (US); Kenneth Garnet Fry, Jr., Spokane, WA (US)

(72) Inventors: Mark Kent Williams, Colbert, WA (US); Kenneth Garnet Fry, Jr., Spokane, WA (US)

(73) Assignee: F. Balwyker Investments, LLC, Mead, WA (US)

( * ) Notice: Subject to any disclaimer, the term of this patent is extended or adjusted under 35 U.S.C. 154(b) by 0 days.

(21) Appl. No.: 14/848,597

(22) Filed: Sep. 9, 2015

(65) Prior Publication Data

US 2017/0066577 A1 Mar. 9, 2017

(51) Int. Cl.
*F16L 3/08* (2006.01)
*B65D 63/10* (2006.01)

(52) U.S. Cl.
CPC .... *B65D 63/1072* (2013.01); *B65D 2563/107* (2013.01)

(58) Field of Classification Search
CPC . B65D 63/1072; Y10T 24/14; Y10T 24/1498; Y10T 292/507
See application file for complete search history.

(56) References Cited

U.S. PATENT DOCUMENTS 3,416,198 A 12/1968 Geisinger
3,556,575 A 1/1971 Farkas
4,001,919 A 1/1977 Moberg et al.
4,138,770 A * 2/1979 Barrette ..... B65D 63/1072 24/16 PB
4,214,349 A 7/1980 Munch
4,501,049 A 2/1985 Adamson
4,532,679 A 8/1985 Scott
4,537,432 A 8/1985 Meeks
4,688,302 A * 8/1987 Caveney ..... B65D 63/1072 24/16 PB
4,754,529 A 7/1988 Paradis
4,906,013 A * 3/1990 Hussien ..... A63C 3/00 280/11.12
5,146,654 A 9/1992 Caveney et al.
5,389,330 A 2/1995 Sorensen et al.
D363,212 S * 10/1995 Hill ..... D8/356
5,470,520 A 11/1995 Sorensen et al.
5,524,945 A 6/1996 Georgopoulos et al.
5,544,391 A * 8/1996 Hoffman ..... B65D 63/14 24/16 PB (Continued)

*Primary Examiner* — David Upchurch
(74) *Attorney, Agent, or Firm* — Randall Danskin, P.S.

(57) ABSTRACT

An improved twist off cable tie fastener having an elongate flexible strap defining a plurality of parallel adjacent transverse teeth. First end portion of elongate strap is tapered to a rounded tip for insertion through a channel defined in a dimensionally larger head portion carried at opposing end of the elongate strap. At least one angulated tooth carried by a flexing arm within the channel irremovably engages with the transverse teeth defined in the elongate strap. The head portion has two opposing and spaced apart wings to facilitate grasping and rotation by a user about a minor transverse axis of the elongate strap. Partial rotation of the wings concentrates strap fracturing forces at a position immediately adjacent to the head portion causing destruction of the cable tie fastener and allowing removal thereof without tools.

1 Claim, 4 Drawing Sheets

(56) References Cited

U.S. PATENT DOCUMENTS

| | | | | |
|---|---|---|---|---|
| 5,636,412 | A | 6/1997 | Lodi et al. | |
| 5,911,368 | A | 6/1999 | Davignon | |
| 5,956,814 | A | 9/1999 | Choi | |
| 6,044,524 | A * | 4/2000 | Sorensen | B65D 63/1072 24/16 PB |
| 6,185,792 | B1 | 2/2001 | Nelson et al. | |
| 6,347,435 | B1 * | 2/2002 | Davignon | B65D 63/1063 24/16 PB |
| 6,449,808 | B1 | 9/2002 | Zappa et al. | |
| 6,789,341 | B1 | 9/2004 | Badura | |
| 7,017,237 | B2 | 3/2006 | Magno, Jr. et al. | |
| 7,052,055 | B1 | 5/2006 | Castro | |
| 7,127,779 | B2 | 10/2006 | Hewes | |
| 7,740,210 | B2 | 6/2010 | Pilon et al. | |
| 7,934,297 | B2 | 5/2011 | Williams et al. | |
| D721,951 | S | 2/2015 | Williams et al. | |
| 2002/0152589 | A1 | 10/2002 | Wada et al. | |
| 2007/0119030 | A1 * | 5/2007 | Hoffman | B65D 63/14 24/16 PB |
| 2010/0071169 | A1 * | 3/2010 | Williams | B65D 63/1072 24/16 PB |

* cited by examiner

TWIST OFF CABLE TIE FASTENER

RELATED APPLICATIONS

There are no other patent applications related hereto heretofore filed in the United States of America or in any other country.

BACKGROUND OF INVENTION

Field of Invention

This invention relates to clasps and closures and more particularly to single use fasteners having a head portion defining a slot at one end of an elongate strap that loops over and irremovably engages in the slot.

Background and Description of Prior Art

Fasteners of the instant type are commonly referred to as "cable ties" and are well-known for fastening items together such as container latches, bundles of wire and groupings of flexible tubular members, Typically the fastener is threaded through adjacent aligned holes defined in portions of a container that move distally from one another when the container is opened, or the fastener is extended circumferentially around the bundle of wires or groupings of items to secure the wires or groupings of items in proximity to one another.

Generally, cable ties have an elongate strap that is tapered at one end portion. Opposite the tapered end portion is a dimensionally larger head portion defining a slot through which the tapered end portion of the elongate strap may be inserted. A resiliently displaceable pawl is carried within the slot and the pawl engages with one of a plurality of transverse grooves defined in the elongate strap.

Cable tie type fasteners are typically single use items. Once the elongate strap is inserted through the slot and the pawl has engaged with the parallel transverse grooves, the elongate strap cannot be withdrawn from the slot without breaking the pawl, breaking the elongate strap or otherwise physically destroying the cable tie. Once the cable tie has been broken, it cannot be repaired or re-affixed.

The inability to remove a fastened cable tie without physically or functionally destroying the cable tie is both a desirable feature and a drawback.

Because of theft single use nature, cable ties are commonly used in apparatus that require security, such as the transport of money, pharmaceuticals and other valuable commodities. When a container of the commodity is filled, closed and thereafter secured with a cable tie, it can reasonably be assumed that if the container, and in-place cable tie, are undisturbed when the container is later opened, and that the container and contents have not been tampered with, Conversely, if the container or the cable tie have been broken, it can reasonably be assumed that the original contents of the container have been tampered with and are no longer in the same condition and perhaps same quantity, as they were when the cable tie was originally secured to the container.

In the pharmaceutical industry, cable ties are used to securely close pharmaceutical tote boxes. A tote box arriving with the cable tie broken or damaged can be rejected or at a minimum closely inspected. In other instances it is desirable to have a strong and secure fastener that may be quickly engaged/fastened when necessary and also quickly and easily removed, for example in outdoor activities such as camping where securing items together is necessary, such as joining tarps together or securing items to tree branches. Further, in law enforcement activities such fasteners may be used as restraints for persons being detained. In both such examples of use, the strong and secure fastener is required, but being able to quickly and easily remove/destroy the fastener is also necessary.

By the same token, one of the drawbacks of cable ties is that they are difficult to break. Cutting the cable tie with a wire cutter or knife poses a risk of unintentionally damaging the item being secured and requires use of a tool. Breaking the cable tie by inserting an elongate rigid object, such as a screwdriver, through the looped elongate strap and twisting the inserted object to break the cable tie is even more likely to damage the item secured by the cable tie.

There are known "tear away" cable ties designed for easy removal. Known tear away cable ties have a planar rectilinear tag adjacent the head portion and define a "scored" or "weakened" area between the tag and the head portion. Pulling on the rectilinear tag portion tears the cable tie at the "scored/weakened" area detaching the head portion from the strap portion without use of a tool or cutting device. Unfortunately, shearing forces such as those used to intentionally break known "tear away" cable ties may be inadvertently applied to the cable tie if the rectilinear tag is inadvertently caught between two surfaces that move relative to one another, such as a top and a bottom or adjacent sides of adjacent containers being transported in a vehicle. Any movement wherein one container moves along and across an adjacent container may provide the necessary shearing motion to break known tear away cable ties. Further, known "tear away" cable ties with rectilinear tags have sharp edges and corners, they are not aesthetically pleasing, they are difficult to package in bundles because the rectilinear tags "catch" on one another and they can be difficult to manufacturer.

What is needed is a durable secure cable tie type fastener that cannot be removed without destroying the cable tie, but can be intentionally removed without resorting to took and without damaging the item being secured. The cable tie must be easy to use, not subject to unintentional breakage, aesthetically pleasing and easy to manufacture and package.

Our improved twist off cable tie fastener addresses various of these drawbacks by providing a product that is strong and secure and is less likely to be inadvertently and unintentionally broken, but can also be broken without use of took when desired. When broken, the fact the cable tie has been broken is un-mistakenly identifiable.

Our invention is an improved twist off cable tie type fastener comprising an elongate strap of flexible yet strong plastic, preferably polypropylene, that defines a plurality of parallel adjacent transverse teeth in the elongate strap. One end portion of the elongate strap is tapered to a rounded tip to ease insertion through a through channel defined in a head portion integrally carried at the end of the elongate strap opposite the tapered tip.

The through channel carries an angled flexing arm having plural angular teeth that cooperatively engage with the transverse teeth defined in the elongate strap. The angulated teeth carried by the flexing arm are configured to prevent the elongate strap from being withdrawn from the through channel once inserted therethrough and a channel frame around the through channel prevents insertion of took that might be used to tamper with the flexing arm.

The head portion defining the through channel is generally rectilinear in peripheral configuration and structurally carries two opposing spaced apart planar wings on its side portions with the two wings oriented parallel to an axis of the through channel and perpendicular to the elongate strap. This orientation causes any excess length of the elongate strap that is drawn through the medial channel when the fastener is in use to extend outwardly between the two spaced apart wings which allows space saving and allows use of the fastener in locations with limited space.

A notch may be formed in the elongate strap immediately adjacent the head portion to ensure fracturing occurs at a predetermined location. The notch does not negatively affect the axial or tensile strength of the cable tie.

The wings carried by the head portion facilitate grasping and twisting of the head portion by a user. The twisting action which is along a minor transverse axis of the elongate strap and perpendicular to a longitudinal axis of the elongate strap concentrates breaking forces on the elongate strap immediately adjacent the head portion. The perpendicular rotation of the wings breaks the cable tie allowing the cable tie's removal without tools and without damaging the item to which the cable tie was fastened. Further, limited rotational movement of the wings, of less than approximately one full 360 degree rotation is sufficient to fracture the cable tie fastener, and more preferably, less than approximately 180 degrees of rotation is sufficient to fracture the cable tie fastener, and still even more preferably, approximately 90 degrees of rotation is sufficient to fracture the cable tie fastener.

SUMMARY

A first aspect of the present invention relates to an improved twist off cable tie fastener having an elongate strap with opposing side portions and tapered to a rounded tip at one end, the elongate strap defining plural parallel adjacent transverse teeth defined in one side portion and further having a head portion integrally interconnected with the elongate strap opposite the rounded tip, the head portion having a channel frame with a first side and an opposing second side and defining a medial channel extending from the first side to the second side, the channel frame further having a first wing at one side portion and a second wing at an opposing side portion and wherein the first wing and the second wing are oriented parallel to an axis of the medial channel and perpendicular to a longitudinal axis of the elongate strap, the medial channel carrying an angled flexing arm therein for engagement with the transverse teeth defined in the elongate strap, and wherein the rounded tip and a portion of the length of the elongate strap is inserted in and passed through the medial channel in only one direction and cannot removed therefrom, and destruction and removal of the cable tie fastener occurs by partial rotational motion of the first and second wings about a non-coaxially aligned axis of the elongate strap.

Still another aspect of the present invention relates to an improved twist off cable tie fastener having an elongate strap with opposing side portions and tapered to a rounded tip at one end, the elongate strap defining plural parallel adjacent transverse teeth defined in one side portion and further having a head portion integrally interconnected with the elongate strap opposite the rounded tip, the head portion having a channel frame with a first side and an opposing second side and defining a medial channel extending from the first side to the second side, the channel frame further having a first wing at one side portion and a second wing at an opposing side portion and wherein the first wing and the second wing are oriented parallel to an axis of the medial channel and perpendicular to a longitudinal axis of the elongate strap, the medial channel carrying an angled flexing arm therein for engagement with the transverse teeth defined in the elongate strap, and wherein the rounded tip and a portion of the length of the elongate strap is inserted in and passed through the medial channel in only one direction and cannot removed therefrom, and destruction and removal of the fastener occurs by partial rotational motion of the first and second wings about a non-longitudinally aligned axis of the elongate strap.

Still another aspect of the present invention relates to an improved twist off cable tie fastener having an elongate strap with opposing side portions and tapered to a rounded tip at one end, the elongate strap defining plural parallel adjacent transverse teeth defined in one side portion and further having a head portion integrally interconnected with the elongate strap opposite the rounded tip, the head portion having a channel frame with a first side and an opposing second side and defining a medial channel extending from the first side to the second side, the channel frame further having a first wing at one side portion and a second wing at an opposing side portion and wherein the first wing and the second wing are oriented parallel to an axis of the medial channel and perpendicular to a longitudinal axis of the elongate strap, the medial channel carrying an angled flexing arm therein for engagement with the transverse teeth defined in the elongate strap and wherein the rounded tip and a portion of the length of the elongate strap, is inserted in and passed through the medial channel in only one direction and cannot removed therefrom, and destruction and removal of the fastener occurs by partial rotational motion of the first and second wings about a minor transverse axis of the elongate strap.

Still another aspect of the present invention relates to an improved twist off cable tie fastener having an elongate strap with a first side portion, a second side portion and tapered to a rounded tip at one end portion, the elongate trap defining plural parallel adjacent transverse teeth defined in the first side portion, and further having a head portion integrally interconnected with the elongate strap opposite the rounded tip, the head portion having a channel frame with a first side and an opposing second side and defining a medial channel extending from the first side to the second side, the channel frame further having a first wing at one side portion and a second wing at an opposing side portion, the medial channel positioned between the first wing and the second wing, and wherein the first wing and the second wing are oriented parallel to an axis of the medial channel and perpendicular to a longitudinal axis of the elongate strap, the medial channel carrying therein an angled flexing arm having plural teeth on an end portion distal from the channel frame for engagement with the transverse teeth defined in the elongate strap, and wherein the rounded tip and a portion of the length of the elongate strap is inserted in and passed through the medial channel in only one direction and cannot removed therefrom, and destruction and removal of the fastener occurs by simultaneous rotation of the first wing and the second wing about a minor transverse axis of the elongate strap which concentrates breaking forces on the elongate strap immediately adjacent to the head portion causing destruction of the fastener and allowing removal thereof without tools.

A still further aspect is to provide an improved twist off cable tie fastener that is of new and novel design, of rugged and durable nature, of simple and economic manufacture and one that is otherwise well suited to the uses and purposes for which it is intended.

Other and further aspects of our invention will appear from the following specification and accompanying drawings which form a part hereof. In carrying out the objects of our invention it is to be understood that its structures and features are susceptible to change in design and arrangement with only one preferred and practical embodiment of the best known mode being illustrated in the accompanying drawings and specified as is required.

BRIEF DESCRIPTIONS OF DRAWINGS

In the accompanying drawings which form a part hereof and wherein like numbers refer to similar parts throughout:

DESCRIPTION OF PREFERRED EMBODIMENT

Figure 1:
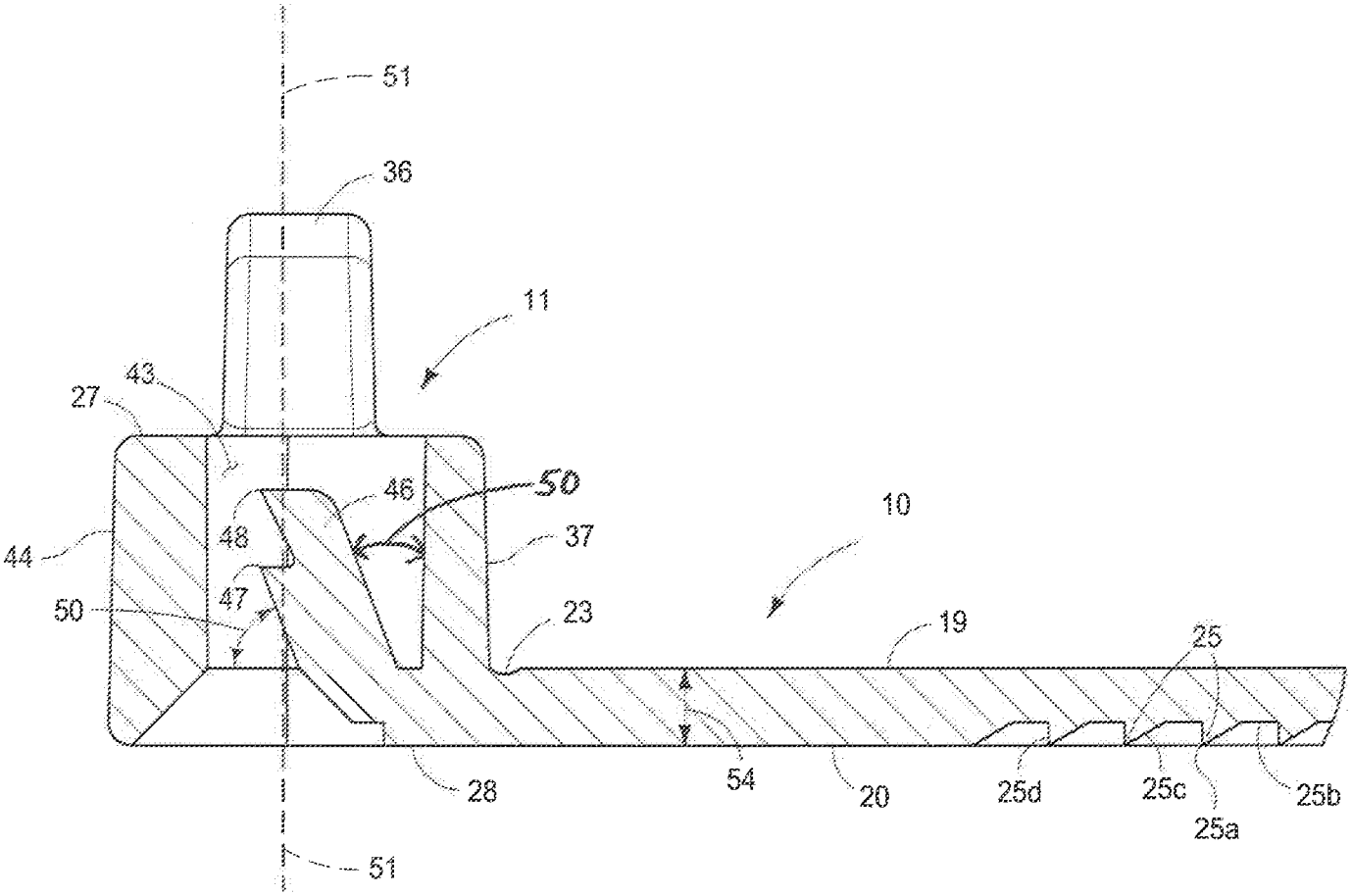
FIG. 1 is an enlarged orthographic cross-section side view of the improved twist off cable tie fastener taken on line 1-1 of FIG. 2 showing the flexing arm within the medial channel, the orientation of the wings, the minor transverse axis of the elongate arm and the configuration of the plural transverse teeth defined in the elongate strap.
Figure 2:
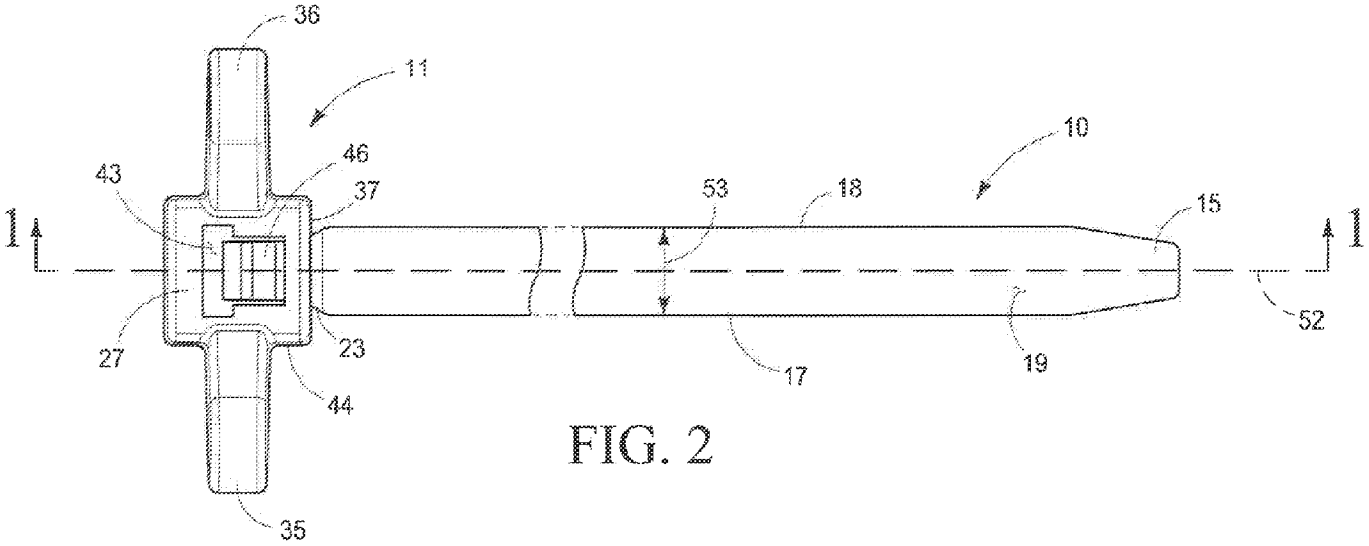
FIG. 2 is a partial cutaway orthographic top plan view of the improved twist off cable tie fastener of FIG. 1 showing the major transverse axis.

An improved twist off cable tie fastener generally provides an elongate strap 10 having a head portion 11 with a channel frame 44 defining a medial through channel 43. The elongate strap 10 and head portion 11 are integrally formed as a single unit, such as by injection molding, and is preferably formed of polypropylene, but may also be formed of nylon, polyethylene and other flexible resiliently deformable plastics and/or thermoplastics.

The elongate strap 10 carries the head portion 11 at one end and is tapered to a rounded tip 15 at the opposing end portion to ease insertion into and through the medial channel 43. The elongate strap 10 has a first side 19 and an opposing second side 20 defined by a first elongate edge portion 17 and a second elongate edge portion 18.

The first side 19 is generally planar and smooth to ease movement of the elongate strap 10 through the channel 43. A plurality of parallel adjacent teeth 25 are defined in the second side 20 of the elongate strap 10 and extend transversely partially across the second side 20 from a position spaced apart from the first elongate edge portion 17 to a position spaced apart from the second elongate edge portion 18, leaving a toothless border 26 adjacent the first elongate edge 17 and a toothless border 26 adjacent the second elongate edge 18. The teeth 25 are defined in the second side 20 from a position spaced apart from the rounded tip 15 to a position spaced apart from the head portion 11.

As shown in FIG. 1, each transverse tooth 25 defined in the elongate strap 10 has a crest 25*a*, a trough 25*b*, a ramp portion 25*c* and a relief 25*d* and collectively form a plurality of transverse teeth 25 along the elongate strap 10 that may easily pass, only in one direction, through the channel 43 while frictionally engaging with an angulated flexing arm 46 carried within the channel 43. Each of the plurality of transverse teeth 25 defined in the elongate strap 10 are dimensionally similar to a distal end portion of the flexing arm 46 which carries strap engaging teeth 47, 48.

The head portion 11 is somewhat "wingnut" in shape having a first wing 35 at one lateral edge and a second wing 36 at an opposing lateral edge. Each wing 35, 36 is integrally formed with the head portion 11 to extend laterally outwardly from the channel frame 44 which defines the medial channel 43 extending transversely through the head 11 portion from a first side 27 to a second side 28. The first and second wings 35, 36 respectively, are each aligned with an axis 51 of the channel 43 so that the two wings 35, 36 are each oriented generally perpendicularly to the first and second elongate sides 17, 18 respectively of the elongate strap 10 and extend in a direction toward the first side 27 of the head portion 11. This orientation of the first and second wings 35, 36 respectively, causes any forces generated by rotational movement (FIG. 7) of the wings 35, 36 to be along a minor transverse axis 51 of the elongate strap 10. This orientation, which causes the rounded tip portion 15 of the elongate strap 10 to extend outwardly between the two wings 35, 36 when the improved fastener is in use, also allows the improved fastener to be used in locations having limited space because all portions that extend outwardly (away from the item being secured) are oriented along the same plane. As noted previously, the elongate strap 10 is integrally formed with and is connected to the head portion 11 channel frame 44 at a peripheral edge portion 37 generally medially between the first wing 35 and second wing 36. A notch 23 may be defined in the elongate strap 10 immediately adjacent the head portion 11 creating a localized area having reduced resistance to applied rotational motion along with the minor transverse axis.

Figure 3:
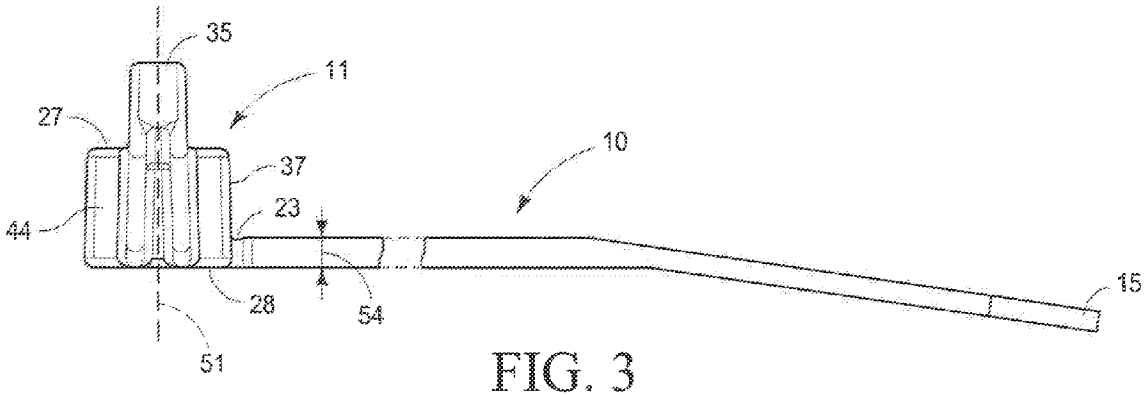
FIG. 3 is a partial cutaway orthographic side view of the improved twist off cable tie fastener of FIG. 1 showing the axis of the medial channel and alignment of the two wings therewith.
Figures 4, 5:
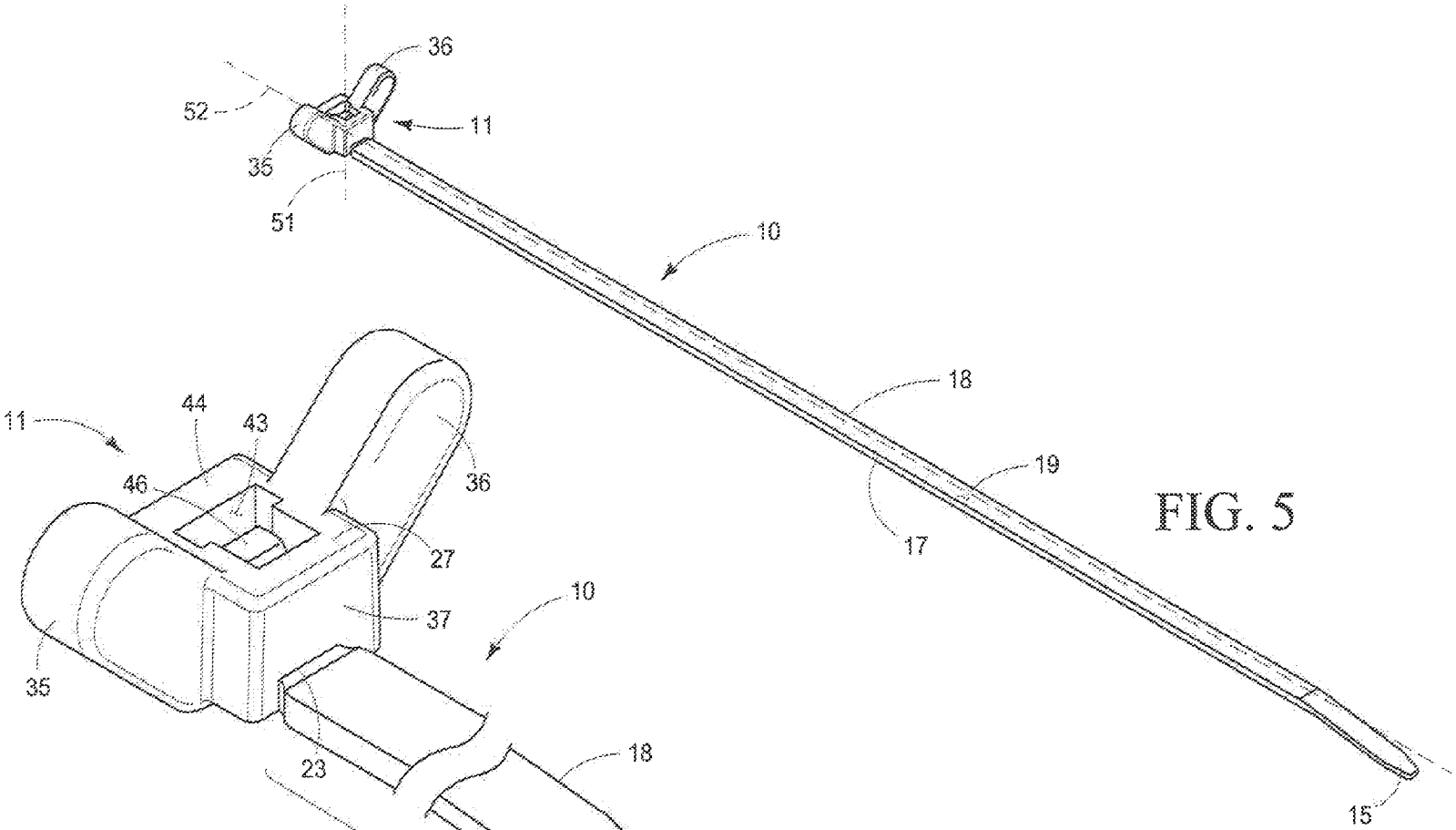
FIG. 4 is an enlarged isometric partial cut-away top, end and side view of the head portion of the improved twist off cable tie fastener.
FIG. 5 is an isometric top, side and end view of the improved twist off cable tie fastener.
Figure 8:
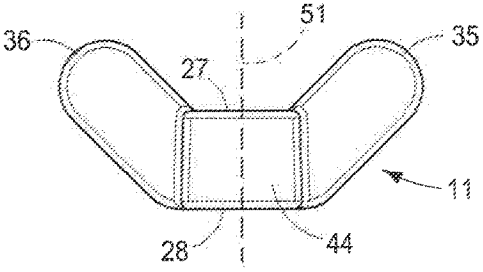
FIG. 8 is an orthographic end view of the head portion opposite the elongate strap.
Figure 7:
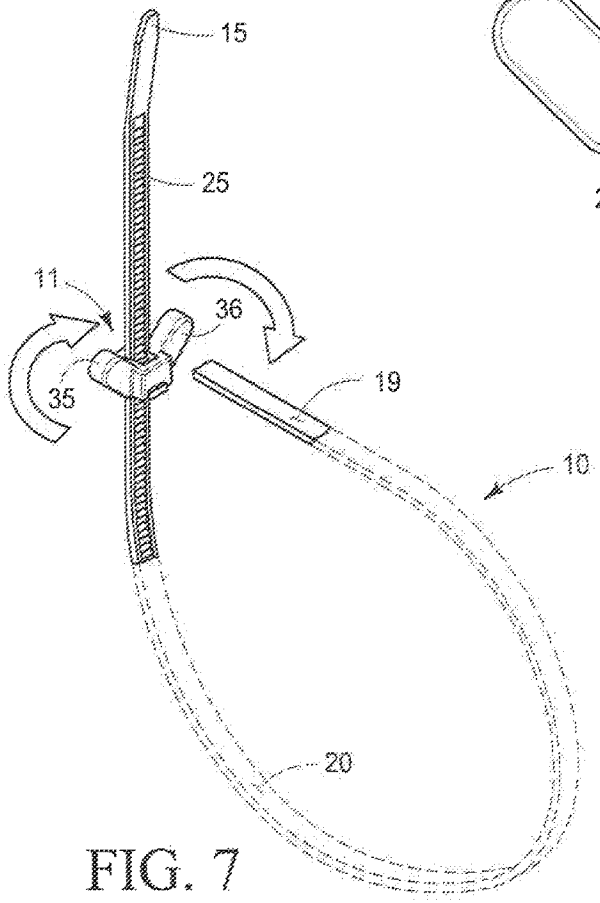
FIG. 7 is a an isometric top and side view similar to that of FIG. 6 with arrows showing the direction of force having been applied to the wings causing the improved twist off cable tie fastener to break adjacent the head portion.
Figure 6:
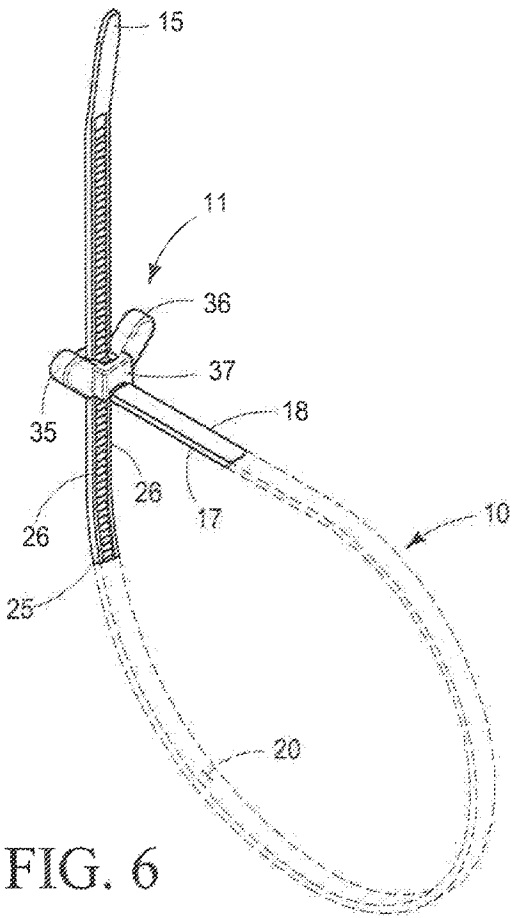
FIG. 6 is an isometric top and side view of the improved twist off cable tie fastener showing the elongated strap threaded through and engaged within the medial channel as the fastener would be used.

As shown in FIGS. 1, 2, 3, 5, 6, 7 and 8 the axis 51 which is defined by the medial channel 43 passes through the medial channel 43 extending between the first side 27 and the second side 28 of the channel frame 44. The axis 51 is oriented perpendicular to the length of the elongate strap 10 and is aligned parallel to the opposing planar surfaces of the two opposing wings 35, 36 carried on each opposing lateral side of the channel frame 44 as is shown in FIGS. 1 and 3. The orientation of the medial channel 44 and the two opposing wings 35, 36 as shown in FIGS. 6 and 7 causes the rounded tip 15 of the elongate strap 10 opposite the channel frame 44 to extend outwardly from the channel frame 44 between the two opposing wings 35, 36 and coaxially with the axis 51 of the medial channel 43 when the instant improved twist-off cable tie fastener is in use. (FIG. 6) Further still, this alignment and orientation positions the two opposing wings 35, 36 so that twisting/torqueing forces exerted on the wings 35, 36 by the user focuses shearing forces on the elongate strap 10 immediately adjacent the connection of the elongate strap 10 to the channel frame 44 which allows destruction/fracture of the elongate strap 10 immediately adjacent the channel frame 44 and allowing tool-less removal of the instant improved twist-off cable tie fastener.

The channel frame 44 is generally rectilinear and defines the through channel 43 into which the rounded tip portion 15 of the elongate strap 10 is inserted. The side-to-side dimension of the channel 43 is only slightly greater than the distance between the first elongate edge 17 and the second elongate edge 18 along a major transverse axis 53 of the elongate strap 10, and the channel 43 is sized and configured to allow passage of the elongate strap 10 therethrough with limited friction while maintaining positional rigidity therebetween to prevent tampering with a flexing arm 46.

The flexing arm 46 is carried within the channel 43 proximate the elongate strap 10. As shown in FIG. 1, the flexing arm 46 is angulated into the channel 43 extending away from the second side 28 of the channel frame 44 and toward the first side 27 of the channel frame 44 at an angle 50 which is established in the manufacturing process. Angle 50 pre-loads the flexing arm 46 to enhance frictional engagement with the teeth 25 defined in the elongate strap 10 when the flexing arm 46 is deflected by the elongate strap 10 being inserted through the channel 43. The angle 50 and resiliency of the flexing arm 46 positionally bias the elongate strap 10 into continuous direct frictional engagement with an opposing surface of the channel 43 opposite the flexing are 46. Angle 50 is preferably between approximately 21 degrees and 35 degrees relative to an adjacent inner surface of the channel frame 44 (See FIG. 1), and more preferably the angle 50 is between approximately 24 degrees and 32 degrees relative to the adjacent inner surface of the channel frame 44, and optimally the angle 50 is 28.04 degrees relative to the adjacent inner surface of the channel frame 44.

End portion of the flexing arm 4$, opposite the connection to the channel frame 44 defines a first arm tooth 47, and in the preferred embodiment, an adjacent parallel second arm tooth 48. The flexing arm teeth 47, 48 are sized and configured to securely engage with the transverse teeth 25 defined in the second side 20 of the elongate strap 10. The toothless borders 26 of the elongate strap 10 slide through the channel 43 in laterally outer areas of the channel 43 that are laterally outward of the flexing arm 46 to further increase positional engagement of the elongate strap 10 within the channel 43 and to further reduce the likelihood of successful tampering with the flexing arm 46.

The "wingnut" configuration of the head portion 11 including the opposing spaced apart wings 35, 36 facilitate grasping and rotation of the head portion 11 by a user. The rotational motion of the wings 35, 36 concentrates the rotational movement about the minor transverse axis 51 of the elongate strap 10 which concentrates breaking forces on the elongate strap 10 immediately adjacent the head portion 11. The rotational motion of the head portion 11 fractures the improved twist off cable tie fastener facilitating destruction of and removal of the improved cable tie fastener without use of tools and without damaging any item the improved twist off cable tie fastener might be securing.

Having described the structure of our improved twist off cable tie fastener, its operation may be understood.

The improved twist off cable tie fastener is positioned about items (not shown) to be secured, or items (not shown) to be secured together such as a grouping of wires (not shown), or a portion of a toy displayed within a "display box". The elongate strap 10 is extended about the items (not shown) and the rounded tip portion 15 is looped there-about and then inserted into the channel 43 entering the channel 43 from the second side 28 of the head portion 11 and exiting the first side 27 of the head portion 11 immediately between the first wing 35 and the second wing 36.

The rounded tip portion 15 is grasped by the user, and drawn at least partially through the channel 43 so that some portion of the elongate strap 10 defining teeth 25 passes through the channel 43. As the elongate strap 10 passes through the channel 43 the teeth 47, 48, respectively carried by the flexing arm 46 engage with the teeth 25 defined in the second side 20 of the elongate strap 10. The angulation 50 of the flexing arm 46 relative to the elongate strap 10, and the resiliency of the material forming the improved cable tie fastener allows the flexing arm 46 to bend toward the first side of the head 27 effectively allowing the crests 25*a* of the teeth 25 to pass over the flexing arm teeth 47, 48 until the elongate strap 10 is snug about the item(s) (not shown) being secured.

The retentive memory of the flexing arm 46 causes the teeth 47, 48 to engage with the teeth 25 defined in the second side 20 of the elongate strap 10 when the elongate strap 10 is no longer being drawn through the channel 43. If the user attempts to withdraw the elongate strap 10 from the channel 43 in the reverse direction, the configuration and angulation of the flexing arm 46 and the flexing arm teeth 47, 48 which are engaged with the elongate strap teeth 25 prevent the withdrawal of the elongate strap 10 from the channel 43.

To remove the fastener, the user grasps the head portion 11 and applies a rotational force to the head portion 11 by means of rotating the two wings 35, 36 simultaneously in a clockwise direction, or simultaneously in a counterclockwise direction about the axis 51 of the through channel 43. The twisting of the head portion 11 concentrates fracturing forces at the interconnection of the elongate strap 10 and head portion 11. The preferred polypropylene material of the improved cable tie fastener is resistant to tensive forces and to shearing forces but is less resistant to rotational forces. The rotational force applied by the twisting of the head portion 11 causes the improved twist off cable tie fastener to break allowing the cable tie's destruction and subsequent removal without tools. Once the cable tie fastener has been destroyed, it cannot be reaffixed.

The foregoing description of our invention is necessarily of a detailed nature so that a specific embodiment of a best mode may be set forth as is required, but it is to be understood that various modifications of details, and rearrangement, substitution and multiplication of parts may be resorted to without departing from its spirit, essence or scope.

Having thusly described our invention, what we desire to protect by Letters Patent, and

We claim:

1. An improved twist-off cable tie comprising:

an elongated strap having first and second side portions which are oriented in spaced, parallel relation one relative to the other, and wherein the elongated strap has a first, distal end defining a tapered tip, and a second proximal end, and wherein a plurality of parallel, transversely disposed and spaced teeth are defined by the first side portion, and wherein the elongated strap has a longitudinal axis extending between the proximal and distal ends thereof, and opposite peripheral edges extending between the first and second side portions;

a head portion integrally connected to the second, proximal end of the elongated strap, and wherein a channel frame is defined by the head portion, and which has opposite first and second sides, and wherein opposite first and second sidewalls extend between the opposite first and second sides, and wherein the opposite first and second sidewalls are located laterally outwardly relative to the opposite peripheral edges of the elongated strap, and wherein the channel frame defines a medial channel extending between the first and second sides of the channel frame, and wherein the medial channel defines an axis extending between the first and second sides of the channel, and which is perpendicular to the longitudinal axis of the elongated strap, and wherein the first side portion of the channel frame defines a plane which is located in spaced, parallel relation relative to the first side portion of the elongated strap, and the second side of the channel frame defines a plane which is coplanar with the second side portion of the elongated strap, and wherein each of the first and second sidewalls has a given height dimension, and width dimension, and wherein the axis defined by the medial channel extends in a direction of passage of the elongate strap through the medial channel;

a first discrete wing having a first proximal end which is made integral with the first sidewall, and a second distal end which is located laterally outwardly of the head portion and extends outwardly beyond the first side of the channel frame opposite the second side of the channel frame, and wherein the first end of the first discrete wing is made integral with the channel frame at a distance which is midway along the width dimension of the first sidewall, and wherein the first discrete wing has two opposing major plane parallel surfaces, and a peripheral edge extending between and substantially about the opposing major plane parallel surfaces, and wherein the opposing major plane parallel surfaces are coplanar with the axis defined by the medial channel and extend in the direction of passage of the elongate strap through the medial channel;

a second discrete wing having a first proximal end which is made integral with the second sidewall, and a second distal end which is located laterally outwardly of the head portion and extends outwardly beyond the first side of the channel frame opposite the second side of the channel frame, and wherein the first end of the second discrete wing is made integral with the channel frame at a distance which is midway along the width dimension of the second sidewall, and wherein the second discrete wing has two opposing major plane parallel surfaces, and a peripheral edge extending between and substantially about the opposing major plane parallel surfaces, and wherein the opposing major plane parallel surfaces are coplanar with the axis defined by the medial channel, and extend in the direction of passage of the elongate strap through the medial channel and are further coplanar with opposing major plane parallel surfaces of the first discrete wing;

a flexing arm which is made integral with the channel frame, and which is operably oriented within the medial channel, and wherein the flexing arm has a distal end which selectively engages with the transverse teeth formed in the elongated strap so as to secure the elongated strap within the medial channel, and wherein the elongated strap when inserted within the medial channel can move in only one direction, and cannot be removed therefrom without the destruction of the cable tie fastener, and wherein the portion of the elongated strap which has been passed through the medial channel defined by the head portion and along the axis defined thereby is coplanar with the opposing major plane parallel surfaces of the each of the first and second discrete wings and the portion of the elongated strap which has been passed through the medial channel defined by the head portion extends in the direction of the second distal ends of the first and second discrete wings, and wherein by exerting torque to the first and second wings the second end of the elongated strap is forcibly separated from the head portion thus causing a destruction of the twist-off cable tie.

* * * * *